United States Patent [19]

Krubsack et al.

[11] Patent Number: 4,953,420

[45] Date of Patent: Sep. 4, 1990

[54] KEY LOCK APPARATUS

[75] Inventors: Larry J. Krubsack, Colgate; John G. Lawton, Milwaukee; Allen L. Handy, North Prairie, all of Wis.

[73] Assignee: Clum Manufacturing Company, Inc., Hartland, Wis.

[21] Appl. No.: 414,914

[22] Filed: Sep. 29, 1989

[51] Int. Cl.[5] ..... E05B 29/06

[52] U.S. Cl. ..... 70/366; 70/377

[58] Field of Search ..... 70/365, 366, 362, 349, 70/377

[56] References Cited

U.S. PATENT DOCUMENTS

| | | | |
|---|---|---|---|
| 1,168,701 | 1/1916 | Babbitt | 70/252 |
| 1,360,622 | 11/1920 | Crouch . | |
| 1,564,883 | 12/1925 | Muzzio . | |
| 1,653,511 | 12/1927 | Schlage | 70/365 |
| 3,404,548 | 10/1968 | Keffer | 70/363 |
| 3,787,812 | 1/1974 | Armstrong | 340/164 |
| 4,016,379 | 4/1977 | Merkle | 200/44 |
| 4,196,606 | 4/1980 | Guiraud | 70/363 |

*Primary Examiner*—Robert L. Wolfe

*Attorney, Agent, or Firm*—Andrus, Sceales, Starke & Sawall

[57] ABSTRACT

A low keylock unit includes an electrical switch unit. A pair of laterally spaced locking levers are pivotally mounted within a rotatable lock tube. The tube extends inwardly into a contact carrier rotatably mounted at the inner end of the switch housing for selective rotation thereof. A rotating switch is coupled to the carrier and selectively engages a fixed contact on a back plate closing the housing. Each lever includes a control leg between a key opening and the pivot and a lock leg between the pivot and the switch unit. A resilient element such as a coil spring compressed between the lock legs or an integral cross between the levers, bears the levers with the lock legs engaging locking grooves on the housing wall to prevent rotation of the tube and the switch unit. A flat key inserted into the lock deflects the legs and pivots the levers outwardly to release the lock legs. If the key is too wide, the control legs move outwardly into the grooves and maintain the locked state. An appropriate key has a final position which partially deflects the control legs within the tube and deflects the lock legs within the tube and thereby positions all legs in a release position within the tube. The control legs and the key are shown with mating truncated edge projections on the control legs and recesses on the key to set the release position and resiliently holds the key within the lock.

22 Claims, 2 Drawing Sheets

FIG. 2
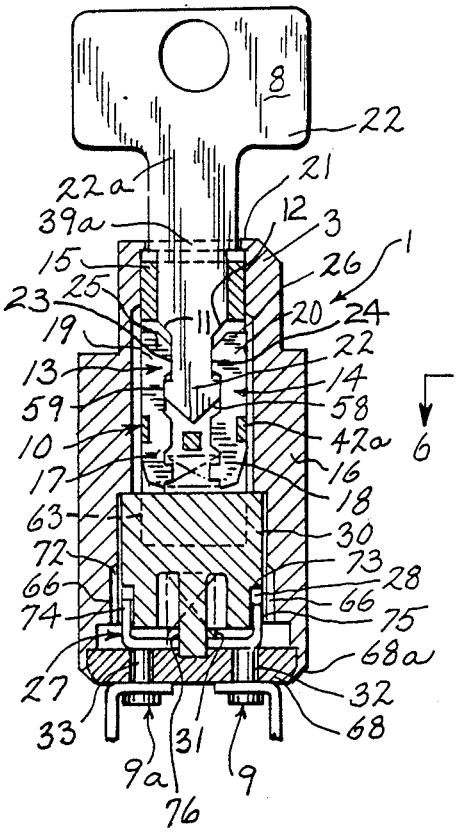
FIG. 6
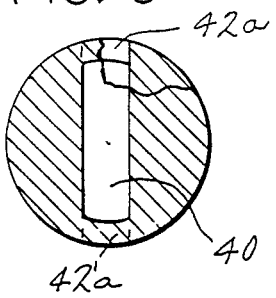
FIG. 9
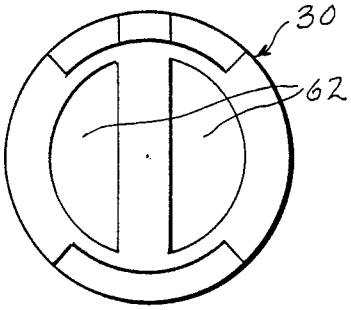
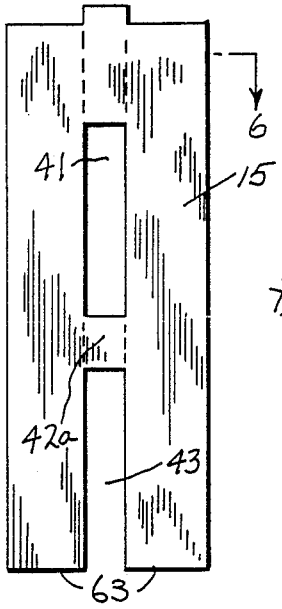
FIG. 5
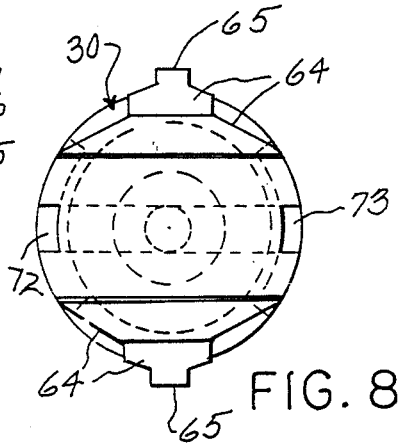
FIG. 8
FIG. 3
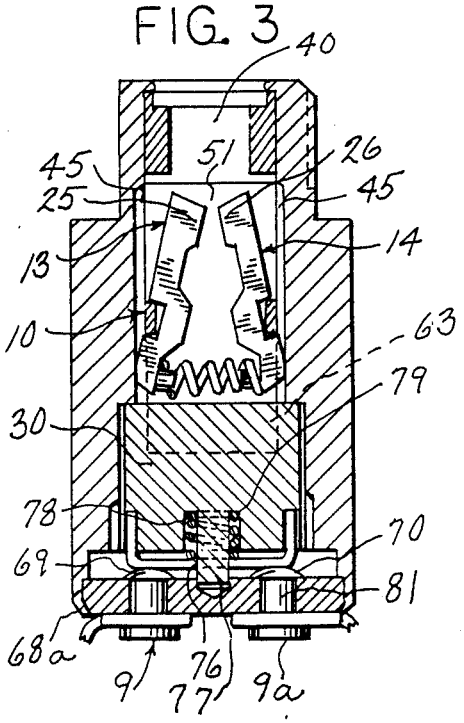
FIG. 7
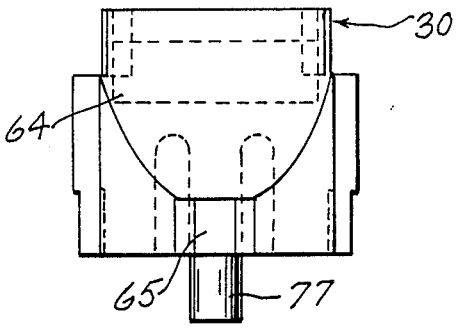
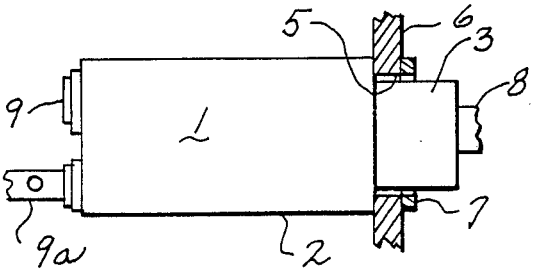
FIG. 1

KEY LOCK APPARATUS

BACKGROUND OF THE PRESENT INVENTION

This invention relates to a key lock apparatus and particularly to a key lock switch apparatus incorporating a low-cost key lock structure.

In many applications, a key switch unit for controlling an electrical circuit is required. In many instances, the cost factor is of substantial significance and the lock structure need not include a complex high security system such as provided by conventional tumbler locks corporated into various door locks, keyed ignition switches for automobiles and the like. Typical applications for low level security key actuated start switches include small lawn equipment, such as lawn tractors, mowers and the like. Other applications would include small motor driven boats, various storage cabinets and the like. A common switch structure used in low security systems include a simple rectangular switch opening having an internal edge surface for restricting actuation of the switch unit to a flat key having a corresponding simple offset edge surface. The key is a simple, flat stamped key structure, generally having a lateral groove or offset with a corresponding notched key to further restrict insertion of a flat member into the key slot for actuation of the key lock structure. With present day low security lock structures, a pin or flat metal member can often be introduced into the key lock for actuating of the key lock structure, thereby effectively eliminating the security factor. Further, the keys are often retained in the lock structure by the frictional engagement of key and internal lock structure. Although in many applications such low cost structures are acceptable, the vibration in the tractor structure may cause the key to actually move from the key lock.

There is therefore a need for a simple but reliable low cost key lock assembly for retaining of the key within the lock with a requirement for positive removal as well as preventing actuation of the key lock unit with a simple inserted plate-like member or the like.

SUMMARY OF THE PRESENT INVENTION

The present invention is directed to a low cost key lock structure particularly adapted for operation and control of an electrical switch incorporated into the lock structure. The present invention is particularly adapted for use in a key switch power unit for lawn tractors and other similar devices. Generally in accordance with the teaching of the present invention, the key lock unit includes a pair of laterally spaced generally aligned lock levers pivotally or resiliently mounted within a rotatable lock tube and bias the levers to an interlock position preventing operation of the switch unit. The levers are adapted to be pivotally displaced during the insertion of a simple flat key member having an edge contour specially shaped to actuate the pivoted lock levers. In particular, the key lock includes an initial portion moving the levers from the lock position while simultaneously moving a second part of the levers to a second locking position which also prevents rotation of the key lock tube. The key edges include a further reset portion allowing the pivoted levers to reset to an intermediate position in which the levers are in a release position allowing and establishing for rotation of the key lock tube. Insertion of a flat key member without the special edge permits the pivoting of the lock levers to release the initial locking position. However, the levers move to automatically set the second lock position and prevent the rotation and actuation of the key lock unit, and requiring insertion of a key portion which resets the lever to a third position in which the levers are in a total release position permitting rotation of the lock tube. In accordance with a preferred structure of the present invention, the internal locking lever structure is preferably constructed with separate locking members or levers having a lock portion and a control portion. A pivotal support for the levers mounts or couples the levers within a rotatable locking member having first and second openings or slots with a pivot bar. Each element is pivoted to the pivot bar. Each of the locking levers are similarly constructed and include a control leg between the key opening and the pivot bar and a lock leg between the pivot bar and the switch unit. A resilient element such as a coil spring is compressed between the locking legs. The innermost lock legs similarly have outward projections mating with the locking groove in the housing and this establishes a non-rotational interlock within the housing. The insertion of a flat element engages cams on the inner side of the outer portion of the control legs and pivots the elements outwardly and thereby release the lock established by the inner lock legs. Such movement however simultaneously moves the control legs outwardly, with the outer leg edges moving into interlocking engagement with the housing unit to again establish a non-rotational position of the locking element. Thus, a simple insertion of a flat member cannot simultaneously release both locking portions or legs. The appropriate key has the final reset position such that with the appropriate key inserted, the inner control legs reset to an intermediate position, allowing the lock legs to return to an intermediate position in which all legs are in a release position.

In a preferred and optimal construction, the key switch lock structure includes an outer housing having an internal cylindrical bore. A rotational lock assembly is rotatably mounted within the bore of the housing with the innermost end coupled to rotate a contact carrier for opening and closing a circuit. The housing has longitudinal grooves on diametric sides of the bore. The lock assembly includes a tube constructed to receive the two locking elements and includes a pair of oppositely disposed longitudinal edge slots within which elements are located. The innermost lock legs are biased outwardly by the spring with the outer edges including projections mating with the grooves in the housing to prevent rotation of the rotational lock tube, thereby preventing rotation of the contact carrier. The outermost control legs of the elements have its outer edges aligned with the slot and housing groove and are biased inwardly with the control legs spaced from locking grooves and totally located within the lock tube. The control legs are formed with similar inward truncated projections defining a restricted entrance into the control legs. The key member for operating of the lock includes an outer head of a width substantially greater than the space between the control legs. Immediately adjacent to the key head, the key edges include a pair of truncated recesses complementing the configuration to the inward truncated projections of the control legs and defining a width substantially less than the head width. The initial insertion of the key pivots the locking elements, with the lock legs pivoting to a release position and the control legs pivoting outwardly into the grooves and to a lock position. The final insertion of the key however moves the key head past the truncated projections which then align with the complementing key truncated recesses. The width between the recesses is specially constructed for a proper return pivot establishing the intermediate position of the side elements, in which the lock legs are pivoted partially inwardly sufficient to establish a lock release position and the control legs are pivoted outwardly but remain in a release position, thereby releasing locking elements and the interconnected tube and attached carrier for rotation. Rotation of the key rotates the lock tube and contact carrier for setting of the contacts in the alternate positions for opening and closing the circuits.

The separate locking levers and resilient positioning element may be formed as an integral H-shaped element, or otherwise formed, to provide the sequential position of interconnected control members and lock members.

Thus, the present invention provides a relative simple and low cost keylock apparatus particularly adapted for keyed switch units based on the sequential positioning of at least one locking unit having the integrated control portion and lock portion.

BRIEF DESCRIPTION OF THE DRAWINGS

The drawings furnished herewith generally illustrate the best mode presently contemplated for the invention and are described hereinafter.

In the drawings:

FIG. 1 is an elevational view of a key lock switch unit illustrating an embodiment of the present invention;

FIG. 2 is a longitudinal section through the key lock unit illustrated in FIG. 1 with the key in place;

FIG. 3 is a view similar to FIG. 2 with the key removed;

FIG. 5 is an elevational view of a lock tube shown in FIGS. 2–4;

FIG. 6 is a sectional view of the lock tube;

FIG. 7 is a side elevational view of a contact carrier;

FIG. 8 is a bottom view of the contact carrier;

FIG. 9 is a top view out the contact carrier; and

DESCRIPTION OF THE ILLUSTRATED EMBODIMENTS

Figure 4:
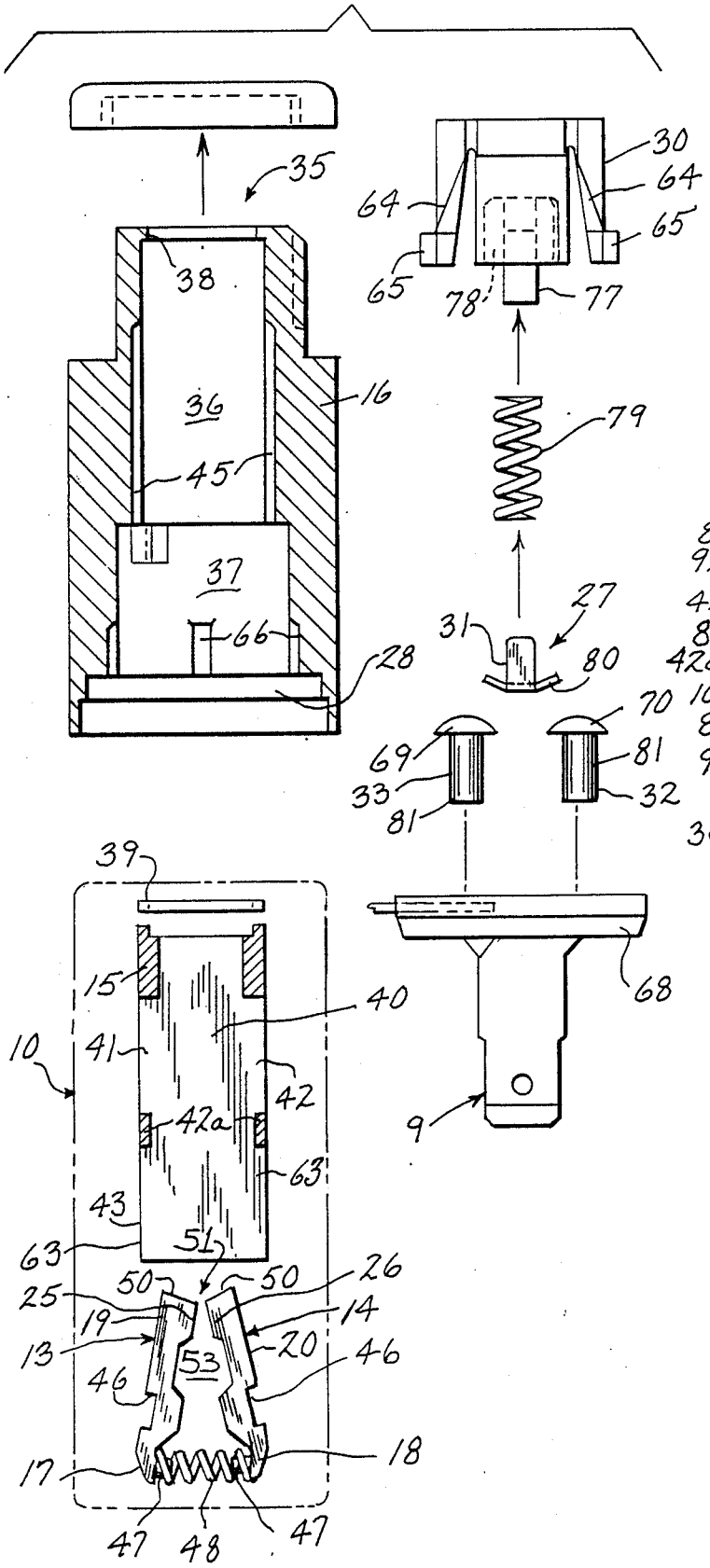
FIG. 4 is an exploded view of the components.

Referring to the drawings and particularly to FIG. 1, a key lock switch unit 1 is illustrated including an outer tubular cylindrical housing 2 with a stepped down portion 3 at a key receiving end. The stepped down portion 3 defines a shoulder 4 for mounting of the key lock switch unit 1 within an opening 5 in a wall structure 6 with the reduced portion projecting through the opening. A locking device 7 is secured to the reduced portion to mount the key lock switch unit 1 to the wall 6. The outer end is adapted to receive a key 8 which is specially constructed to actuate the key lock switch unit 1 and provide rotation of an internal mechanism, as more fully described hereinafter, to complete the circuit between a pair of contact terminals 9 and **9*a* on the inner end of the unit 1. The contact terminals 9 and 9*a* are connected in any suitable circuit. The key lock switch unit 1 for example, may be mounted to the front cover panel 6** of a lawn tractor, not shown, and provide for connection of the ignition system in accordance with well known circuit connections.

Referring to FIGS. 2–4, the present invention is a key encoded lock assembly 10 within the key lock unit 1 requiring an insertion of a key 8 with a particular edge configuration. In the illustrated embodiment of the invention, the key 8 is a flat conventional stamped key having opposed specially shaped outer longitudinal edges 11 and 12 which complement the configuration of a pair of spaced lock elements 13 and 14, respectively, of assembly 10.

Generally, the internal key lock assembly 10 includes a rotating lock member shown as tube 15 rotatably mounted with the outer lock housing 16. The lock elements 13 and 14 are movably mounted for selectively engagement with the housing 16 to conjointly control the rotation of the tube 15. In the illustrated embodiment of the invention, each lock element 13 and 14 has a corresponding first or lock leg 17 and 18, respectively biased outwardly into locking engagement with housing 16 to prevent rotation of the element. Each locking element 13 and 14 includes a second or control leg 19 and 20, respectively, which is similarly located adjacent the entrance to the key-end opening 21 of housing 16 and normally biases inwardly in spaced relation to the housing 16 and a release position. Insertion of an improper key 8 causes the outer control legs 19–20 to move outwardly into a locking position with housing 16 while simultaneously moving the inner locking legs 17 and 18 from the housing 16 to a release position. The lock unit 1 is thus maintained in a locked condition or state preventing rotation of the actuator tube 15 of lock assembly 10. Only if a key 8 with the specially formed edges 11 and 12 which complement the inner configuration of the lock elements 13 and 14, will both lock and control legs of elements 13 and 14 be placed in the release position.

The illustrated key 8 includes a large head 22 adapted to release the lock legs 17 and 18 and simultanteoulsy establish the second lock via the engaged locking legs 19 and 20. Immediately following the head enlargement, release recesses 23 and 24 are formed in the respective edges 11 and 12. The lock legs 19 and 20 have inward projections 25 and 26, respectively, which complement recesses 24 and 25. Further, key insertion aligns the projections 25 and 26 with recesses 24 and 25 which provides partial release and reset of the lock elements 11 and 12 which maintain the key lock legs 17 and 18 released and thereby releases legs 19 and 20, effectively releasing lock mechanism assembly 10 and permitting turning of the key lock unit for rotation and actuation of a contact assembly 27 within a contact chamber 28 in the inner end of housing 16.

A rotating contact carrier 30 is located within housing 16 and is coupled to the lock tube 15 for rotation therewith. A bridging contact 31 is secured to the end of carrier 30 and located to selectively engage fixed contacts 32 and 33, which are connected to terminals 9 and 10.

Although particularly applied to a key lock switch unit 1, the invention can be applied to any simplified key lock unit having a load element connected to the rotating assembly, such as a mechanical latch or the like.

The total lock unit 1 consists of a minimum number of components, namely, the outer housing, the rotating actuator coupled to a contact carrier and the dual lock elements as well as appropriate end closure structures, as more fully described hereinafter. The several components as will become more clear from the following detailed description are all simple, readily mass produced components thereby providing a key lock switch unit 1 at a minimum cost and with reasonable security. The illustrated embodiment also establishes reliable key retention under operating conditions even in rather severe vibrational conditions such as encountered with lawn tractors and the like. A reasonable level of security at least equal to or greater than that specified and heretofore provided in connection with the usual lawn tractor and similar applicance, is also created.

More particularly, in the illustrated embodiment of the invention, the outer housing 16 is a generally tubular member having a cylindrical opening or bore 35 extended throughout the length of the housing. The bore 35 includes an outer lock section 36, within which lock assembly 10 is located, and an inner contact section 37 of a somewhat enlarged diameter, within which the contact carrier 30 is rotatably mounted. The end key entrance opening in the housing 16 includes an inward lip 38 to form a stop for the lock assembly 10.

The outer end of the housing 16 includes a round opening of a diameter less than the external diameter of the tube 15 and defines the encircling lip 38. The lock tube 15 is held in rotatable engagement within the bore of the housing 16. The adjacent outer end of the key lock tube 15 is recessed inwardly of the locking lip 38 and is coupled to a a key cap 39 which abuts the lip 38. The cap 39 defines a lateral slotted opening aligned with the slot in tube 15 for receiving of a flat key.

The key 8 is shown as a flat key member having the outer enlarged operating handle 22 for convenient graspong by the operator's fingers for insertion and turning of the key. A shank 39*a* projects from the operating handle with a width slightly less than the key opening in the cap and slot and of a length to project into the control legs 19 and 20 of the locking member. The shank 39*a* and the opening in cap 39 may be formed with complementing offset portions or other special configurations to increase the security, as by an offset within shank and a corresponding mating offset in the cap opening.

More particularly, the lock assembly 10 includes the outer locking tube 15 which is a round cylinder member having a centrally located diametric slot 40 which extends throughout the longitudinal length of the member. The slot width at the key entrance lip 38 defines a restricted portion of a width essentially corresponding to the width of the key 8 inserted into the lock unit 1. Immediately inwardly of the key entrance section, the slot 40 extends laterally throughout the width of the tube 15, as at 41 and 42, to expose the adjacent interior wall of the housing 16. The openings 41 and 42 are aligned with the control legs 19 and 20 approximately at the middle of the tube 15 and a bridging wall 42*a*. The openings 41 and 42 are aligned with the control legs 19 and 20. The slot 40 to the inner side of wall 42*a* includes openings 43 and 44 which expose the interior wall of the housing 16, with legs 17 and 18 aligned with the opening 43 and 44. The interior wall of the housing 16 is provided with similar longitudinal recess or grooves 45 in alignment with the openings 41 and 43 and openings 42 and 44, respectively. The lock elements 13 and 14 are similar members shown as flat elongated straps with a connecting recess 46 on the outer edges in alignment with the connection of the legs 17 to 19 and legs 18 to 20.

The elements 13 are further similarly formed with spring retaining legs or posts 47 on the inner edges of the legs 17 and 18. A coil spring 48 extends onto posts 47 and is compressed between the legs 17 and 18 and urges the elements 13 and 14 to the position shown in FIGS. 3 and 4.

As illustrated in FIGS. 2 and 3, in the assembled relation, the elements 13 and 14 pivot on the walls 42*a*. The spring 48 deflects the two lock legs 17 and 18 outwardly into locking engagement with the grooves 45.

With the elements 13 and 14 located within the locking tube 15 and the key removed, the control legs 19 and 20 are located between the walls 42 a and the key entrance end opening. The outward deflection of lock legs 17 and 18 results in an inward deflection of the control legs 19 and 20 within tube 15, as shown in FIG. 3.

In the unstressed state as shown in FIGS. 3 and 4, the outer edges of the control legs 19 and 20 are spaced slightly and include a similar opposed inclined cam edges 50 defining a generally V-shaped opening 51. The cam edges extend inwardly to substantially close the key opening. The back side of the cam edges include a reverse cam surfaces and defines an enlarged opening 53 adjacent wall 42*a* and the pivot unit for elements 13 and 14. The cam edges 50 and 51 thus define opposed truncated projections 25 and 26.

The key 8 is formed with the generally complementing lock actuating portion 22–24 in shank. Thus, the illustrated key 8 is a conventional flat key member which can be readily formed by stamping or the like. The face of the shank is provided with a laterally struck-out projection, not shown, with a corresponding notch in cap 39 in accordance with conventional practice.

The outermost key end is formed as a head 22 having a substantially pointed end 58. The input angle of inclination of end 58 generally correspondes to the angle of the V-shaped opening 51 to cam edges 50 of the control locks 19 and 20. The V-shaped end 58 terminates in a short straight edge 59 extending parallel to each other. As the key 8 is inserted, the V-shaped end 58 engages the cam edges 50 and deflects the control legs 19 and 20 outwardly until the straight edges 59 move through the legs. In this position, the locking legs 19 and 20 are deflected outwardly into a maximum position and in particular with the outer locking edges disposed within the longitudinal slots or grooves 45 in the housing 16. Immediately outwardly of the straight edges, the key end includes a reverse inclined edge defining truncated notches 23 and 24 having a configuration essentially complementing the engaged truncated projections 25 and 26 of the control legs 19 and 20. Thus, insertion of the key 8 with the head 22 and notches 23 and 24 aligned with the projections 25 and 26, the control legs 19 and 20 pivot toward each other and from the locking grooves 45 in the housing 16. However, the intermediate portion of the key 8 between the complementing recesses or notches 23 and 24 has a depth which prevents the complete return of the control legs 19 and 20 to the normal unstressed condition of FIG. 3 and holds them in a partially deflected position. In this partially deflected position, the locking legs 17 and 18 are held deflected partially inwardly, and sufficiently to space the outer locking edges from the locking grooves 45. As a result, the locking elements 13 and 14 are held within the boundary of the tube 15, and the tube 15 is free to rotate within the bore of the housing 16 for positioning the contact 27.

The innermost end of the tube 15 is shown coupled to contact carrier, as follows.

The carrier 30 is a block-like cylindrical member having a central cylindrical portion with a flat end located abutting the shoulder between the lock tube bore opening and the key contact carrier bore opening. The flat end of the key carrier includes side edge recesses 62 which mate with and complement the innermost ends 63 of the tube 15 to the opposite sides of the central slot. Rotation of the lock tube assembly 10 and particularaly the lock tube 15 results in rotation of the carrier 30.

The opposite sides of the carrier 30 include integral cantilevered side arms 64 which project outwardly from the tube coupling end of the carrier 30, and terminate in the outer end in lateral projections or tabs 65. The housing wall within the carrier chamber includes four latch notches 66 in the wall of the housing. Notches 66 are equicircumferentially spaced to form first and second sets of latch notches spaced by 90 degrees and thus diametrically of the carrier. With the carrier projections 65 mating one set of notches 66, the carrier 30 is held in a first position. Rotation of said carrier 30 through 90 degrees, aligns tabs 66 with the second set of notches 66 and holds the carrier 30 in a second position.

The innermost end of the carrier 30 is located in a common plane of a contact chamber 28 formed in the innermost end of the housing 16. The contact chamber has a stepped wall including an outer opening within which a contact back plate 68 is secured and an inner opening together, which the contacts are located. The back plate is secured within the housing 16 in any suitable manner and is shown secured by crimping of the inner end of the housing 16 over the back wall, as at **68*a* in FIGS. 2 and 3. The edge of the back plate is formed with a slightly inclined surface for securely locking the back plate to the housing 16. A pair of spaced contacts 69 and 70, and forming the inner end of terminals 9 and 10 are secured to contact plate 68 and aligned in diametric spaced relation. U-shaped contact 27 is coupled to the carrier 30 and rotates with the carrier. In the one position of the carrier, the contact 27 bridges the contacts 69 and 70 to complete a circuit between terminals 9 and 10. In the alternate position of the contact 27, it is located between the contacts 69 and 70 and opens the circuit between the terminals 9 and 10**.

More particularly, the innermost end of the carrier 30 includes side recesses 72 and 73. The U-shaped contact 27 includes inwardly extended legs 74 and 75 essentially complementing and mating with the recesses 72 and 73. The U-shaped contact 27 has a central opening 76. A post 77 on the center portion of the carrier 30 projects outwardly from the carrier through the opening 76 and into an opening in the base plate. A recess 78 encircles the post 77 within the face of the carrier 30. A coil spring 79 is located within such recess and is compressed between the base of the recess 78 and the contact 27. The spring 79 urges the contact 71 outwardly into engagement with the contacts 27 or the contact back plate 68, and simultaneously bias the carrier 30 inwardly into abutting engagement with the shoulder between the carrier chamber or bore and the lock chamber or bore. The bridging contact is a flat metal member having lateral wind tabs 80 which are bent backwardly within the contact chamber to provide an inclined cam surface for moving into and from engagement with the fixed contacts 69 and 70.

The contacts 69 and 70 are shown as simple rivet type members having an inner button-like face. The shank 81 of the contacts 69 and 70 extend outwardly of a backing plate 68 and are cold-worked onto the terminals 9 and **9*a* to secure the contacts to the back plate and to the appropriate terminals 9 and 9*a*. With the bridging contact aligned with the fixed contacts, the outer end portions of the bridging contacts are firmly engaged with the center of the contact buttons with a resilient engagement established by the spring. The spring mounting of the contact 27 permits the free turning of the lock tube 15 and the carrier 30 by the key 8 with the contact 27 moving downwardly onto the insulating wall between the fixed contacts. Reverse keyed rotation of the carrier 30 results in the spring loaded contact 27 riding upwardly on the contact buttons of contacts 69 and 70 into the full line engagements shown in FIGS. 2 and 3**.

Figure 10:
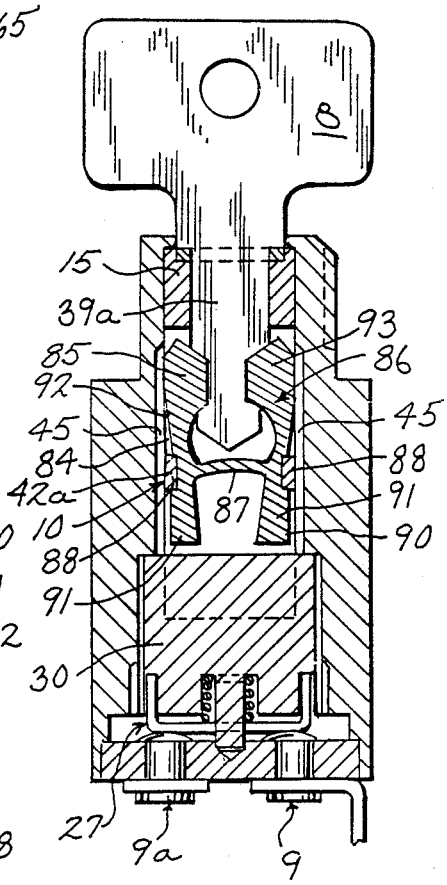
FIG. 10 is a view similar to FIG. 1 illustrating an alternate embodiment of the invention.

An alternate embodiment of the invention is shown in FIG. 10. In this embodiment, an integral H-shaped, locking unit 84 includes side locking elements 85 and 86 joined by cross bar 87. The other parts of the keylock apparatus may be and are shown as in the first embodiment and correspondingly numbered for purposes of explanation.

The H-shaped unit 84 is a relatively flat plate-like element adapted to fit within the slot of the tube 15. The cross bar 87 is generally aligned with the slot wall **42*a*, with the outer edges of the locking elements 85 and 86 similarly notched, as at 88 to complement the aligned walls 42*a*. The notches 88 are of a slightly lesser depth than the walls, with the notch bases spaced to locate the walls within the notches in the assembly and thereby retain the H-shaped locking member in place without restricting the described movement of the lock elements 85 and 86. The locking legs 89 and 90 have the outer edge extensions 91 which in the unstressed state extend outwardly of the nominal edges of the balance of the lock element, and move outwardly into the aligned recesses or grooves 45 on the interior wall of the housing 16 for holding and securing of the lock against rotation. The control legs 92 and 93 then located within tube 15. As shown in FIG. 10, appropriate pivoting of elements 85 and 86 release the elements 85 and 86 from the grooves 45** and permit rotation as in the first embodiment.

Various modes of carrying out the invention are contemplated as being within the scope of the following claims particularly pointing out and distinctly claiming the subject matter which is regarded as the invention.

I claim:

1. A keylock unit, comprising a housing having an internal bore, a rotating lock assembly mounted within said bore, said rotating lock assembly including a locking member rotatably mounted within said bore, said locking member having a longitudinal opening extending parallel to the axis of rotation of the locking member and a locking wall fixed within the bore of said housing, said longitudinal opening extending transversely to said locking wall, a locking element movably mounted within said longitudinal opening and having a lock portion and a control portion oppositely movable with respect to said locking wall and movable transversely into locking engagement with said locking wall, said locking element having a pivot support engaging locking member, a resilient means holding said pivot support in said engagement with said locking member and permitting movement of said control element relative to said locking wall and establishing opposite movement of said lock portion and said control portion relative to said locking wall, said housing having a key opening aligned with said longitudinal opening for receiving of a key having an elongated portion for insertion into said lock assembly and having a central portion edge aligned with said opening and thereby aligned with said control portion, said key having an enlarged end portion adapted to engage said control portion to position the control portion into engagement with said locking wall and thereby simultaneously move said lock portion from said locking wall and having a second portion immediately adjacent said enlarged portion to move the control portion and the lock portion in spaced relation to said locking wall and thereby permitting rotation of the lock assembly.

2. The unit of claim 1, including a rotating contact carrier coupled to said lock assembly and rotatable therewith, fixed contacts mounted in opposed sliding relation to said carrier, a movable contact on said carrier selectively engaging said fixed contacts to open and establish electrical conduction between said fixed contacts.

3. The unit of claim 1, wherein said locking element is an integral member having said lock portion and said control portion, a pivotal mount located within said longitudinal opening adjacent said bore and engaging said pivot support of said locking element, said locking element being pivoted on said pivot support about said pivotal mount by said key relative to said locking wall.

4. The unit of claim 3, wherein said locking wall includes first axial grooves aligned with said control portion and a second axial groove aligned with said lock portion and said control portion and said lock portion having a standby position with said locking portion in said groove and a first pivoted position with said locking element out of said groove and said control portion in said groove and a release position with both said lock portion and said control portion spaced from said grooves.

5. The keylock unit of claim 1, wherein said locking member is a lock tube rotatably mounted within said bore, said lock tube having said longitudinal opening in the form of a central slot extending longitudinally throughout and including an inner portion thereof extended diametrically throughout, said locking wall being an integral part of said housing bore and having longitudinally extended grooves aligned with the opposite sides of said slot, said locking element being a single integral element in said slot in alignment with said groove, said control portion having a laterally inward projection on the inner edge of said control portion, whereby a key inserted into said lock assembly engages said projection and pivots said integral element about said pivot support, said key requiring a single maximum width to pivot the integral element to a position locating the lock portion and the control portion within the lock tube, said key having a width in excess of said selected maximum width positioning said control portion within said groove and a key width less than said maximum width locating said lock portion in said groove whereby said lock is coded to a key having a particular key edge configuration.

6. The keylock unit of claim 5, wherein said projection on said control portion define an enlarged recess to the inner ends of said projection, said key having a recess located and complementing the projection and defining a particular width holding said integral element within said lock tube.

7. The keylock unit of claim 5, including a rotating contact carrier within the inner end of said housing, interengaging member on said carrier projecting into said lock tube and coupling the carrier to said tube for rotation, said contact carrier having means engaging said housing, said housing having means to latch said carrier in a first position, and in a second position, fixed contacts secured to said housing, a movable contact secured to said carrier and adapted to engage said fixed contacts in said first position and spaced from said fixed contacts in said second of said position.

8. The keylock unit of claim 7, wherein said housing includes circumferentially spaced recesses in alignment with said carrier, said carrier having resilient arms including outward projections, whereby rotation of said carrier selectively aligns said projections with said recesses and resiliently holds the carrier in said first and second positions.

9. A keylock apparatus including an outer support having an internal longitudinally extended cylindrical bore, a lock assembly rotatably mounted within said bore, said lock assembly including a lock tube rotatably mounted within said bore, said lock tube having a central opening extending longitudinally throughout an inner portion thereof and having side edge slots on diametric opposite sides of the tube, said support bore having longitudinally extended and diametrically spaced grooves aligned with said opening, a lock unit mounted within said opening and including laterally spaced locking elements aligned within said slot and in alignment with said grooves, a generally centrally located pivot support secured to said lock tube within the length of the locking elements, said locking elements having as intermediate portion abutting said pivot support, resilient means engaging and biasing said locking elements into pivoting engagement about said pivot support to support said locking elements within said slot, said locking elements including a lock leg at the innermost end pivoted outwardly by said resilient means into said groove to prevent rotation of said lock assembly, control legs at the centermost end of said locking elements, said lock legs pivoting inwardly within said lock tube in response to the outward pivoting of said control legs, said control legs of said locking elements having opposed inner edges whereby a key inserted into said lock assembly engages said control legs and pivots said elements about said pivot means, said control legs defining an operative key including a single maximum width to pivot the elements to a position locating the lock legs width the lock tube and the control legs within the lock tube, a key width in excess of said selected width positioning said control legs within said grooves and a key width less than said maximum locating said lock legs in said grooves whereby said lock assembly is coded to a key having a particular key edge configuration.

10. The keylock apparatus of claim 9, wherein said projections on said control legs are aligned and define an enlarged opening to the inner ends of said projections, said key having a recess located and complementing the projections and defining a particular width to hold said control legs and said lock legs within said tube, whereby said key is resiliently held in position within said lock assembly and said lock assembly is rotatable by the resilient engagement of said projection and said recesses.

11. The keylock apparatus of claim 9, wherein said lock unit is an H-shaped member with said locking elements forming the side legs and the locking elements joined by a cross-member at a common connection of said control legs to said lock legs, said cross-member being deflected within said lock tube and defining said resilient means, and said pivot means including interengaging offset surfaces on said tube in alignment with said cross-bar.

12. The keylock apparatus of claim 11, wherein said edge slots include a bar in the slot in alignment with said cross member of said H-shaped member, said locking elements having recesses mating with and seated on said bars.

13. The keylock apparatus of claim 12, wherein said control legs include projections on said opposed inner edges defining an inner enlarged opening inwardly of said projections, said operative key having a symetrically enlarged end head and an adjacent recess complementing said enlarged opening.

14. The keylock apparatus of claim 9, including a rotating contact carrier within the inner end of said housing coupled to said lock tube for rotation, said contact carrier having a pair of spring arms secured to diametrically opposite sides of said carrier and extending longitudinally and outwardly into the outer ends in sliding engagement with said bore, the outer ends of said arms having outward projections, said bore having diameterially located recesses aligned with said projections, whereby rotation of said carrier selectively aligns said projection with said recesses and resiliently holds the carrier in position, fixed contacts secured to said housing, a movable contact secured to said carrier and adapted to engage said fixed contacts in one of said two alternate positions and spaced from said contacts in said second of said alternate positions.

15. The apparatus of claim 9, wherein said pivot support includes a pivot wall within each of said slots and located between the lock leg and the control leg of the locking element, said resilient means being a separate element interposed between said elements and resiliently urging said lock legs outwardly through said slots and into engagement with said housing to lock said lock assembly against rotation.

16. The apparatus of claim 15, wherein said resilient means is a coil spring located between said lock legs, said lock legs having retention elements coupled to said spring.

17. The apparatus of claim 9, wherein said lock tube includes a pivot wall within each said slot located between the lock leg and the control leg of the locking element, each of said locking elements comprises a single integral member having an intermediate recess complementing and mating with said pivot wall, said control leg projecting outwardly and having an inward control tab projection on the inner edge whereby said opposed control legs define a restricted opening, said key engaging projections and positively pivoting said control legs and locking elements outwardly, said lock legs projecting inwardly and having outer side edge portions including an inclined portions located in parallel relation to said bore with said lock in engagement with said groove.

18. The apparatus of claim 17, wherein said resilient means is located between said lock legs and pivoting said locking elements about said pivot walls to place said inclined portions engaging said grooves.

19. The apparatus of claim 18, wherein said resilient means is a coil spring located between said lock legs, said lock legs having retention elements coupled to said spring.

20. A keylock unit adapted to receive a flat strip-like key member for actuating of the lock unit and establishing a key-edge configuration for restricting operation of said lock unit, comprising an outer housing having an inner bore, a rotatable member mounted in said housing and having a center key opening with an edge slot adjacent the bore, a pivot wall located generally centrally of said slot, at least one locking element located in said slot and abutting said pivot wall and including a lock portion and a control portion located to the opposite ends of said pivot walls, a resilient means connected to said locking element and supporting said element in said slot and pivoting said locking element to move the lock portion into engagement with said inner bore, said control portion being located adjacent said key opening and engaged by said key, said control portion moving said lock portion from a lock position to a release position in response to selected key actuated movement of said control portion, said control portion being movable into locking engagement with said housing in response to predetermined movement beyond the movement to release said locking portion and whereby an operative key includes an initial large portion for pivoting said lever member having a second portion aligned with said control portion and constructed to set said control portion released from said housing and simultaneously holding said lock portion released from said housing and thereby establishing a rotational position for said rotatable member.

21. A keylock unit, comprising a housing having an internal bore, a rotating lock assembly mounted within said bore, said rotating lock assembly including a lock member rotatably mounted within said bore, said locking member having a longitudinal opening extending parallel to the axis of rotation of the locking member and a locking wall fixed within the bore of said housing, said longitudinal opening extending transversely to said locking wall, a lock element movably mounted within said longitudinal opening and movable transversely into locking engagement with said locking wall, a control element movably mounted within said opening into locking engagement with said locking wall, means coupling said control element and said lock element with the movement of said control element relative to said locking wall establishing opposite movement of said lock element relative to said locking wall, said housing having a key opening aligned with said longitudinal opening for receiving of a key having an elongated portion for insertion into said lock assembly and having a central portion edge aligned with said opening and thereby aligned with said control element, said key having an enlarged end portion adapted to move between said control element to position the control elements into engagement with said locking wall and thereby simultaneously move said lock elements from said locking wall and having a second portion immediately adjacent said enlarged portion to move the control element and the lock element in spaced relation to said locking wall and thereby permitting rotation of the lock assembly, a rotating contact carrier within the inner end of said housing, interengaging member on said carrier projecting into said lock tube coupling the carrier to said tube for rotation, said contact carrier having means engaging said housing, said housing having means to latch said carrier in a first position and in a second position, fixed contacts secured to said housing, a movable contact secured to said carrier and adapted to engage said fixed contacts in said first position and spaced from said fixed contacts in said second of said position.

22. The keylock unit of claim 21, wherein said housing includes circumferentially spaced recesses in alignment with said carrier, said carrier having resilient arms including outward projections, whereby rotation of said carrier selectively aligns said projections with said recesses and resiliently holds the carrier in said first and second positions.

* * * * *

UNITED STATES PATENT AND TRADEMARK OFFICE

CERTIFICATE OF CORRECTION

PATENT NO. : 4,953,420

DATED : September 4, 1990

INVENTOR(S) : LARRY J. KRUBSACK ET AL

It is certified that error appears in the above-identified patent and that said Letters Patent is hereby corrected as shown below:

Claim 1, col. 8, line 65, after "engaging" insert ---said---; Claim 1, col. 9, line 1, delete "element" and substitute therefor ---portion---; Claim 4, col. 9, line 37, after "said" delete "locking" and substitute therefor ---lock---; Claim 4, col. 9, lines 38-39, after "said" delete "locking element" and subsitute therefor ---lock portion---; Claim 7, col. 10, line 10, after "first position" delete "," (comma); Claim 9, col. 10, line 37, delete "as" and substitute therefor ---an---; Claim 9, col. 10, line 44, delete "centermost" and substitute therefor ---outermost---; Claim 9, col. 10, line 54, delete "width" and substitute therefor ---within---; Claim 17, col. 11, line 65, after "lock" insert ---legs---.

Signed and Sealed this

Eighth Day of September, 1992

*Attest:*

DOUGLAS B. COMER

*Attesting Officer*

*Acting Commissioner of Patents and Trademarks*